United States Patent [19]

Niida

[11] 4,038,814

[45] Aug. 2, 1977

[54] WRISTWATCH STRUCTURE

[75] Inventor: Yutaka Niida, Tokorozawa, Japan

[73] Assignee: Citizen Watch Co., Ltd., Tokyo, Japan

[21] Appl. No.: 659,024

[22] Filed: Feb. 18, 1976

[30] Foreign Application Priority Data

Feb. 18, 1975 Japan ..... 50-20035

[51] Int. Cl.[2] ..... G04B 19/30; G04C 3/00

[52] U.S. Cl. ..... 58/23 R; 58/1 M; 58/43; 58/50 R; 58/55; 58/88 R

[58] Field of Search ..... 50/1 M, 23 R, 33, 42.5, 50/43, 50 R, 55, 85.5, 88 R

[56] References Cited

U.S. PATENT DOCUMENTS

| | | | |
|---|---|---|---|
| 3,693,344 | 9/1972 | Cleusix | 58/42.5 |
| 3,759,031 | 9/1973 | McCullough et al. | 58/50 R |
| 3,782,102 | 1/1974 | Bergey | 58/50 R |
| 3,911,663 | 10/1975 | Kern et al. | 58/55 X |

*Primary Examiner*—Stanley J. Witkowski
*Attorney, Agent, or Firm*—Spensley, Horn and Lubitz

[57] ABSTRACT

An electronic watch in a watch case comprising a crystal oscillator, an integrated circuit chip having at least an oscillator circuit and display device, a battery, at least two magnetically operated switches for controlling the watch functions, and one or more magnets movably coupled to the watch case for operating the switches. The magnets and the switches are arranged such that the switches are operated by manually moving the magnet to magnetize any of the switches, thereby increasing the water-proof competency with easier handling.

9 Claims, 7 Drawing Figures

WRISTWATCH STRUCTURE

BACKGROUND OF THE INVENTION

1. Field of the Invention

The present invention relates to battery wristwatches, and more particularly, to wristwatches having switches that are externally operated.

2. Prior Art

In the past years, light emitting diodes and liquid crystal display elements have become widely employed for time display devices in timepieces. Since these devices have their electronic circuits compactly integrated, they have expandable applications depending upon demand by adding an accesory, such as a memory circuit or a calculator circuit. However, the more the display device has, the more switch means are required to perform these functions. As a result, using a conventional type of switch means, such as push buttons or rotatable crowns it is difficult to maintain satisfactory waterproofing between the watch case and the switch devices. In order to achieve good waterproofing, a more complex process is required to manufacture those watches which would lead to a high manufacturing cost.

Particularly in the case of light emitting diodes and liquid crystal display elements, whose durability might be easily damaged by humidity, the protection against humidity is a big requirement. Another consideration which is peculiar to watches is that they are designed so tightly that once humidified inside, the watch cannot be free from humidity for a long time. Therefore, humidity must be strictly shut off at the switch means-watchcase contact.

In an attempt to satisfy this requirement, it has been commercially introduced to utilize a "reed switch", i.e. magnetic-sensitive elements, whose leads comprise two or three thin tips confronting each other and which are capsulated altogether. This switch functions as a switch means when it is placed in a circumstance magnetic field to a certain degree. Accordingly, the conventional push buttons or rotatable crowns may be substituted for by a reed switch which works upon bringing a magnet close to the watchcase containing the reed switch as its integral part, thereby improving the waterproof competency.

Most of the prior art watches using those reed switches, however, have their whole switch mechanism made of a combination of reed switches and push buttons where reed switches are used only for adjusting the time and the rest of the switching operation is to be done by push buttons. In these watches, the waterproof competency cannot be satisfactorily high in spite of the reed switches. Furthermore, since the magnet is operated separately from the watch case, it often causes inconveniences such as losing the magnet, taking longer time in the operation. In addition, the number of those reed switches is practically limited to utmost three, for the magnet would affect any neighboring switches besides the particular switch which the user wants to operate, if they are planted too close to each other.

SUMMARY OF THE INVENTION

The primary object of this invention is to provide a watch in which magnets are provided on an orbit in the side wall and magnetic-sensitive elements are arranged along the orbit, thereby eliminating all the drawbacks from which the prior art watches suffer.

Another object of the invention is to provide a watch in which magnetic shields are inserted between the magnetic-sensitive elements so that more selectivity of the magnets can be obtainable, more magnetic-sensitive elements can be installed without disturbing the function of any neighboring elements.

Still another object of this invention is to provide a watch which has magnetic modifiers to select the magnetic flux towards a particular switch by diminishing unnecessary flux thereby improving the magnetic selectivity.

DETAILED DESCRIPTION OF PREFERRED EMBODIMENT

Figure 1:
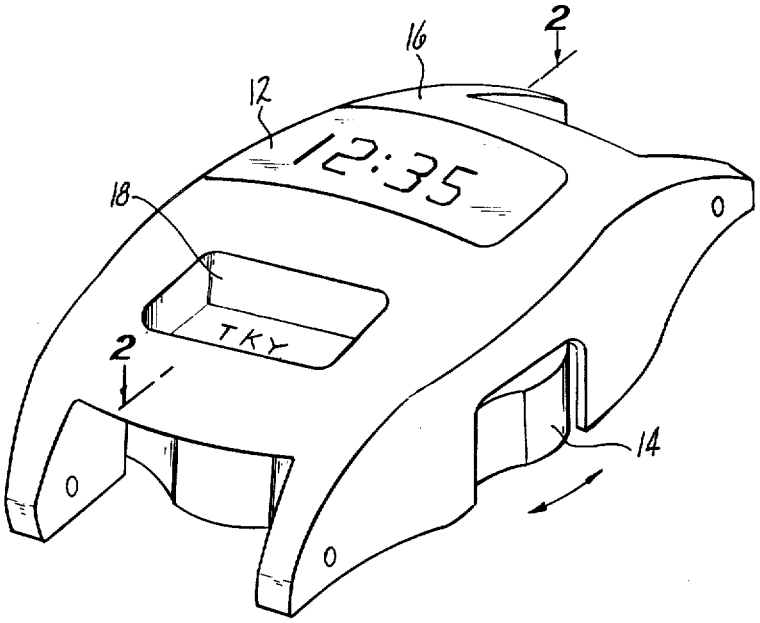
FIG. 1 shows a perspective view of a watch of one embodiment of this invention.

Referring to FIG. 1, where a world-time watch of one embodiment of this invention is illustrated, it is provided with a display device 12 made of light emitting diodes and the time of every major city in the world can be seen by rotating a rotatable switch ring 14. The names of those cities are displayed by print and the like upon the surface of the ring 14 so that the user can seen them through a window 18 of a watchcase 16.

Figure 2:
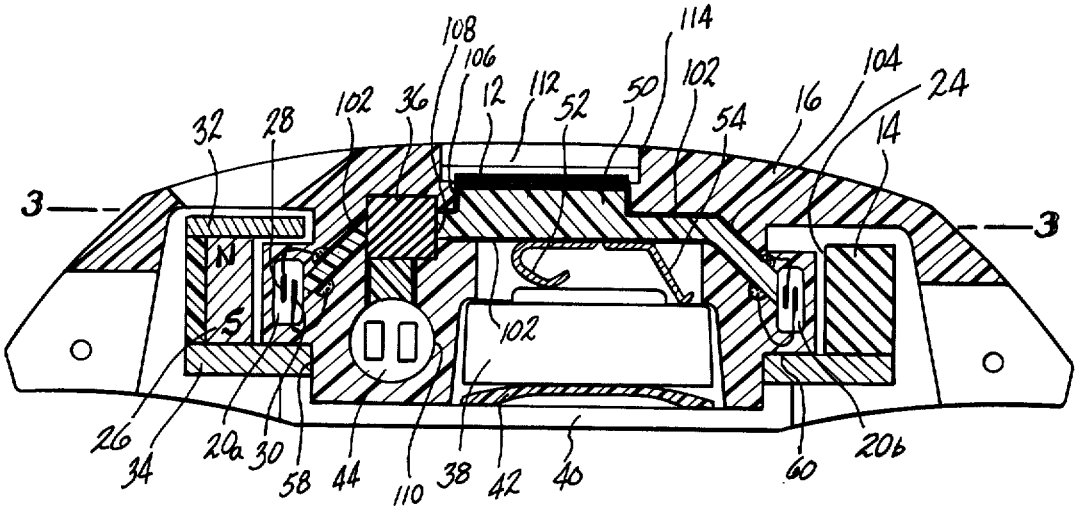
FIG. 2 shows a sectional view taken along line 2—2 in FIG. 1.

Now referring to FIG. 2, which presents a longitudinal sectional view of the watch of FIG. 1, reed switches **20*a* and 20*b* made of magnetic-sensitive elements are arranged adjacent to the inside circumference 24 of the rotatable switch ring 14. In the switch ring 14, there is mounted a magnet 26 so that reed tips 28 and 30 would become attracted to each other to make contact when the magnet 26 approaches the reed switch 20*a* magnetizing the reed tips 28 and 30. Reference numeral 32 designates a yoke plate which improves the magnetization around the reed tips 28 and 30 by intensifying the magnetic flux density; yoke plate 32 is preferable but not essential. An integrated circuit 36 is connected to the reed switches 20*a* and 20*b* and the display device. The integrated circuit 36 and the reed switches are formed into an integral unit together with a crystal vibrator 44 by means of plastic resin and the like. Reference numeral 38 designates a battery, 40 designates a back cover that also works as a battery hatch, and 42** designates a battery supporter with a compressive spring.

The integrated circuit 36 is an electronic circuit comprising an oscillator circuit and a divider circuit which converts pulses from said crystal vibrator into signals suitable for being displayed.

Figure 3:
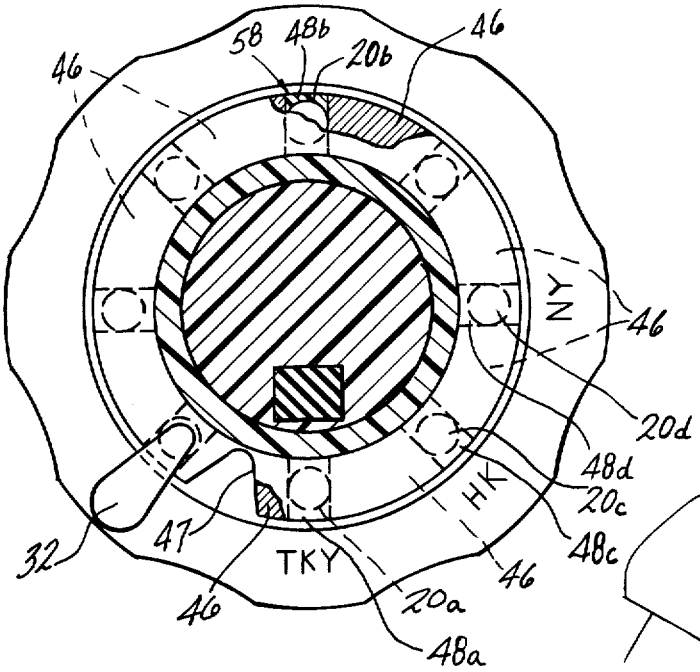
FIG. 3 shows a sectional view taken along lines 3—3 in FIG. 2.

More details are illustrated in FIG. 3 regarding the inter-relationship between the switch ring 14 and the reed switches 20 and 22. The reed switches **20*a*, 20*b*, 20*c* . . . are radially disposed with magnetic shields 46 thereinbetween. The reed switches 20a, 20b, 20c . . . are surrounded by cavities 48a, 48b, 48c . . . so that the magnetic shields 46 will not disturb the magnetization of the magnetic-sensitive elements of the reed switches 20a, 20b, 20c . . . The rotatable switch ring 14 may be partially made of magnetic shield material. On the surface of the rotatable switch ring 14, the names of major cities such as TKY (Tokyo), HK (Hong Kong) are presented so as to be seen through the window 18**.

The watch of this embodiment shown in FIGS. 1–3 may be constructed in such a manner that a wiring pattern 102 is formed by means of ion-plating a disc-like base plate 50 (FIG. 2) made of molded epoxy resin; said base plate 50 includes a sloped portion 104 in its circumference, a rectangular bench 106 at the central area thereof to contain the LED display device 12, a rectangular opening 108 to hold the integrated circuit 36, a cylinder-like container 110 for the standard crystal vibrator 44 extending downward from the base 50. The sector pillar shaped magnetic shields 46, made of pure iron having high magnetic permeability, the reed switches 20a, 20b, 20c . . . , the integrated circuit 36 having ends, the crystal vibrator 44, two electric contacts 52 and 54 having elastic tangs made from sheet metal processing, and the LED display device 12 are put together with adhesive and soldered upon the wiring pattern 102.

The watch body 16 may be formed by pouring the same epoxy resin as the base plate 50 into a mold to contain the plate 50 therein. Then, a protective plate 112 made of muddy transparent plastic, such as acrylic, resin, is glued into a rectangular opening 114 of the watch body 16 so as to be water-insulated. The magnet 26 (preferably made of anisotropic samarium-cobalt magnet or anisotropic cerium-cobalt magnet) has a disc 34 made of any high magnetic permeability material, such as pure iron, fixed upon the bottom thereof. The magnets 26 with the disc 34 are arranged regularly around the rotatable switch ring 14, whose periphery is so shaped that it provides holds. Through an opening 47 of the magnetic shield 46, yoke plates 32 are inserted and mounted upon the magnets 26. After the battery 38 is installed with a battery holder 42 into the watch body 56, the back cover 40 is pressed into said body 46, thereby supporting the battery 38 and switch ring 14. The magnet 26 sandwiched by the plates 32 and the discs 34 is frictionally held and supported between a side projection 60 and a side wall 58 of the cylindrical bottom part of the watch body 16 and the back cover 58.

With respect to the above description, the LED display device and the integrated circuit used in the above embodiment, which are not the subject matter of the present invention, are disclosed by U.S. Pat. No. 3,701,071 issued Dec. 26, 1972; U.S. Pat. No. 3,714,867 issued Feb. 6, 1973; and U.S. Pat. No. 3,721,084 issued Mar. 20, 1973. Further, the additional IC circuit for displaying the worldwide time, whose details are not discussed in this application, is disclosed by U.S. Pat. No. 3,653,204 issued Apr. 4, 1972. Regarding the crystal vibrator, the details are seen in U.S. Pat. No. 3,795,831 issued Mar. 5, 1974.

Figure 4:
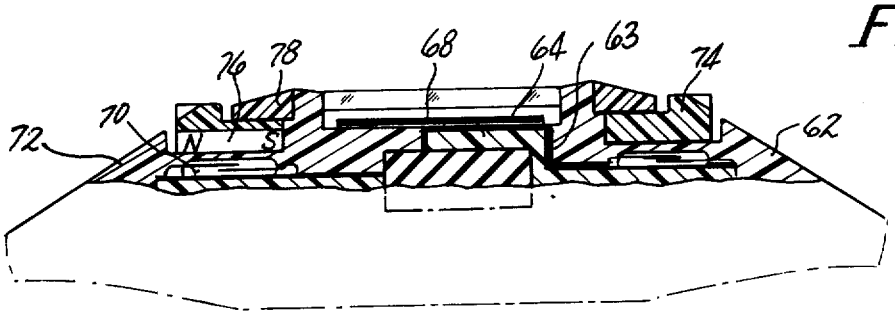
FIG. 4 shows a partial longitudinal sectional view of another embodiment of this invention.

FIG. 4 shows a partial sectional view of the second embodiment of this invention. A round base plate 62 is installed to have an integrated circuit block 64 provided at the center thereof, said base plate 62 being made of plastic (epoxy resin and the like) mold and having a number of benches and concaves for various parts to be settled thereon. Upon the base plate 62, there are provided a LED display device 68 and reed switches 70 arranged radially. Said display device 68 and switches 70 being glued to plate 62 and coupled to a wiring pattern 63 on the base plate 62. The base plate 62 with the above equipment is installed into a watch body 72 in the same manner as described in connection with the first embodiment. A rotatable ring-shaped bezel 74 having a notched rim made of plastic and provided with magnets 76 in the same manner as the switch ring 14 of the first embodiment, is frictionally sustained in terms of its upper, bottom and inside edges. Around the upper cylindrical portion of the watch body 72, a plastic guard 78 is fixedly pressed onto the rotatable bezel 74.

Figure 5:
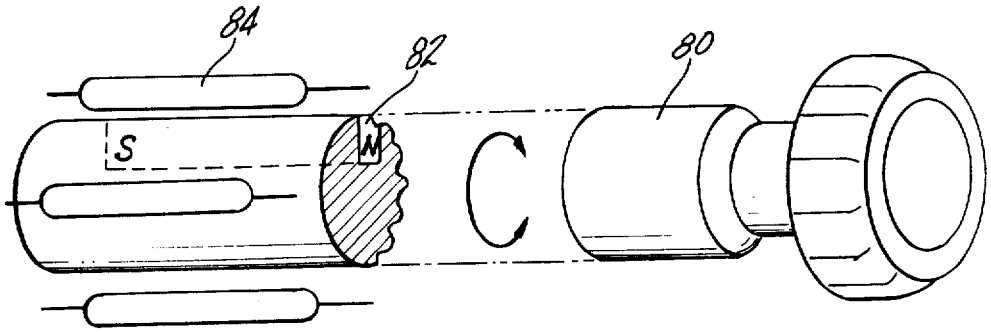
FIG. 5 shows a partially diagrammatic sectional view of a switch means of another embodiment of this invention.

FIG. 5 illustrates a sketch of the essential part of the third embodiment, where magnets 82 are embedded in the periphery of a switch shaft 80 made of non-magnetic metal having a crown formed on the end of the shaft 80. The switch shaft 80 is rotatable and reed switches 84 are arranged around said shaft 80. The reed switches 84 are operated by rotating the switch shaft 80. The mechanical construction and the electric connection of this embodiment is substantially the same as described regarding the first embodiment except for the arrangement of the switch shaft 80 and the reed switches 84.

Figure 7:
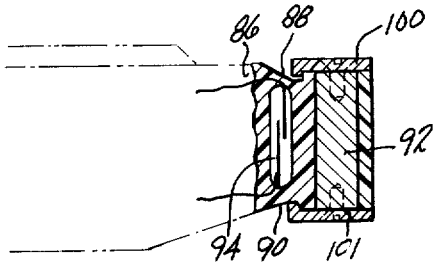
FIG. 7 shows a partial sectional view taken along lines 7—7 in FIG. 6.
Figure 6:
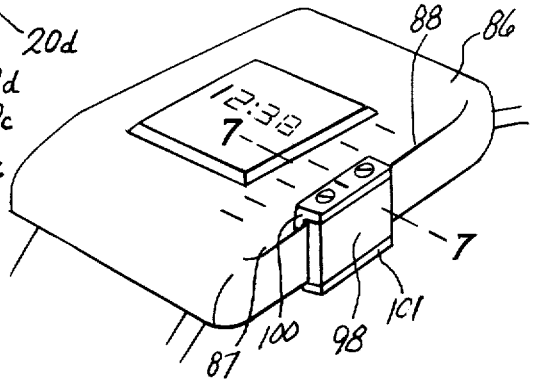
FIG. 6 shows a perspective view of the other embodiment of this invention.

FIGS. 6 and 7 show the fourth embodiment of this invention, where a magnet 92 slides along guide grooves 88 and 90 at a side portion 87 of the watch case 86 to operate a reed switch 94, in contrast to rotating movement of the magnet in the other embodiments. The reed switches 94 are arranged in the watch case 86 along the side portion 87. The upper and lower guide grooves 88 and 90 are provided in the upper and lower surfaces of the side portion 87, and upper and lower L-shaped fasteners 100 and 101 are fixedly screwed upon the slider 98, said L-shaped fasteners 100 and 101 fitting into the upper and lower grooves 88 and 90 respectively, whereby the magnet 92 contained in plastic slider 98 will travel along the guide grooves 88 and 90. The slider 98 is held in place by means of friction unless manually moved. The reed switches are operated by sliding the slider 98 which contains the magnet 92. The grooves 88 and 90 may be formed either in a watch case or in a watch band, and more than one magnet may be employed depending on requirements.

As described above, this invention is primarily applicable to a reed switch comprising magnetic-sensitive elements; however, it is also generally applicable to other switch means having magnetic-sensitive elements, such as a magnetic head comprising Hall elements and a D.C. amplifier circuit. The magnet to be used in this invention may be either a permanent magnet or an electro-magnet, and the battery may be contained either in the watch case or in an external accessory, such as a watch band. Further, the position of the magnets to be held with the rotatable switch ring and the like may be determined by the magnetic attraction of the watch case which is wholly or partially magnetized.

What I claim is:

1. An electronic watch comprising:

a crystal vibrator which generates electric pulses;

an electronic circuit which includes an oscillator circuit with said vibrator and a divider which converts said pulses into signals suited for being displayed;

a display device which makes said signals visible;

a battery for powering said crystal vibrator, electronic circuit and display device;

at least two magnetic-sensitive switch means for controlling said electronic circuit and said display device; and a magnet arranged in a rotatable shaft which has a crown such that when said crown is rotated, said magnetic-sensitive switch means are selectively operated by said magnet.

2. An electronic watch comprising:

a crystal vibrator which generates electric pulses;

an electronic circuit which includes an oscillator circuit with said vibrator and a divider which converts said pulses into signals suited for being displayed;

a display device which makes said signals visible;

a battery for powering said crystal vibrator, electronic circuit and said display;

at least two magnetic sensitive switch means for controlling said electronic circuit and said display device; and at least one magnet contained in at least one slider which is slideably installed along an external side of a watch case such that said switch means are selectively activated by said magnet by sliding said magnet along said external side of said watch case.

3. An electronic watch comprising:

a crystal vibrator which generates electric pulses;

an electronic circuit which includes an oscillator circuit with said vibrator and a divider which converts said pulses into signals suited for being displayed;

a display device which makes the signal visible;

a battery for powering said electronic circuit, display device and crystal vibrator;

at least two switch means for controlling said electronic circuit and said display device;

wherein at least two of said switch means are magnetic-sensitive elements, and movable magnet is so arranged that said magnet is inseparable from a watch case and is movable along an orbit outside said watch case and said magnetic-sensitive elements are arranged along an orbit inside said watch case such that said magnetic-sensitive elements can be selectively operated by said movable magnet by moving said orbit outside said watch case.

4. The electronic watch according to claim 3, wherein one or more magnetic shields are inserted between said elements thereby increasing the magnetic selectivity of said elements by diminishing undesirable side effect to any neighboring elements.

5. The electronic watch according to claim 3, wherein yoke plates are mounted on said magnet in such a manner that said yoke plates form a part of magnetic circuit with said magnets and are movable with said magnet.

6. The electronic watch according to claim 3, wherein said magnetic-sensitive elements constitute reed switches.

7. The electronic watch according to claim 3, wherein said magnet is arranged in a rotatable switch ring which is installed in an external periphery of the watch case.

8. The electronic watch according to claim 3, wherein said display device comprises a group of light emitting diodes.

9. The electronic watch according to claim 3, wherein a watch body is made of an integral plastic unit in such a manner that the battery and a battery cover may be removable and changeable.

* * * * *